US005113841A

United States Patent [19]

Bratcher

[11] Patent Number: 5,113,841

[45] Date of Patent: May 19, 1992

[54] ARCHERY BOW AND BOW RISER THEREFOR

[76] Inventor: William M. Bratcher, 188 W. Shannon La., Shelbyville, Ky. 40165

[21] Appl. No.: 602,624

[22] Filed: Oct. 24, 1990

[51] Int. Cl.[5] ..... F41B 5/00

[52] U.S. Cl. ..... 124/23.1; 124/88

[58] Field of Search ..... 124/23.1, 24.1, 25.6, 124/86, 88

[56] References Cited

U.S. PATENT DOCUMENTS

| | | | |
|---|---|---|---|
| 213,851 | 4/1879 | Streeter | 124/23.1 |
| 218,079 | 6/1879 | Streeter | 124/24.1 |
| 3,171,397 | 3/1965 | Daly | 124/24.1 X |
| 3,517,657 | 6/1970 | Alban | 124/86 X |
| 3,599,621 | 8/1971 | Scrobell | 124/23.1 |
| 3,834,368 | 9/1974 | Geiger | 124/23.1 X |
| 4,257,385 | 3/1981 | Stewart | 124/24.1 |
| 4,457,287 | 7/1984 | Babington | 124/23.1 |
| 4,787,361 | 11/1988 | Vyprachticky | 124/88 |
| 4,881,514 | 11/1989 | Denslow et al. | 124/88 |
| 4,996,968 | 3/1991 | Hollingsworth | 124/24.1 |

*Primary Examiner*—Randolph A. Reese
*Assistant Examiner*—John A. Ricci
*Attorney, Agent, or Firm*—Jon C. Winger

[57] ABSTRACT

An archery bow having a central interconnecting member or bow riser with a generally horizontal hand-grip to be grasped by the archer's bow-supporting hand, and upper and lower oppositely extending coaxial bow limb attachment arms. An upper resilient bow limb is secured at its proximal end to the distal end of the upper bow limb attachment arm, a lower resilient bow limb is secured at its proximal end to the distal end of the lower bow limb attachment arm and a bow string interconnects the distal ends of the resilient upper and lower bow limbs. the hand-grip is transverse to the longitudinal axis of the bow string and substantially laterally centered on the longitudinal axis of the bow string.

9 Claims, 5 Drawing Sheets

ARCHERY BOW AND BOW RISER THEREFOR

BACKGROUND OF THE INVENTION

The present invention relates to archery bows, and more particularly to an archery bow, which effectively eliminates torque loading of the archer's bow supporting hand, wrist, and forearm while also effectively eliminating the problem of the bow string striking the archer's forearm.

The conventional archery bow has a material hand grip which is centered on and in alignment with the longitudinal axis of the bow limbs and, therefore, in substantial alignment with the longitudinal axis of the bow string. There are numerous problems associated with these bows. Because of the vertical alignment of the hand grip, and due to the weakness of the human wrist, the archer must rigidly extend his arm. One problem is that the archer's extended forearm is then in the path of the bow string so that when an arrow is shot, the bow string strikes the archer's forearm causing pain and injury to the archer. The conventional solution is for an archer to wear a forearm guard so that the bow string strikes the forearm guard instead of the archer's forearm. Even further, these conventional bows having the handle in line with the bow limbs create a stress of the archer's wrist, forearm, elbow, back and shoulder.

Various solutions to these problems have been proposed involving reorienting the hand-grip to extend outwardly of the bow transversely of the bow string. Examples of these proposed solutions are shown in the following U.S. Patents.

U.S. Pat. No. 213,851 issued on Apr. 1, 1879 to N. R. Streeter shows an archery bow having a handle which is removably attached to one side of the archery bow and extends outwardly therefrom perpendicular to the bow string.

U.S Pat. No. 218,079 issued on Jul. 29, 1879 also to N. R. Streeter shows an improvement to the archery bow of U.S. Pat. No. 213,851, wherein the transversely, outwardly extending handle is inclined to the longitudinal axis of the bow and the bow string.

U.S. Pat. No. 3,171,397 issued on Mar. 2, 1965 to J. W. Daly shows another archery bow having a handle attached to one side of the archery bow and extends outwardly therefrom. The handle includes a groove formed at the proximal end at its top side for receiving the index finger and another groove formed at the proximal end at its bottom side for receiving the thumb of the archer's bow supporting hand.

U.S. Pat. No. 4,787,361 issued on Nov. 29, 1988 to E. Vyprachticky shows yet another archery bow also having a handle attached to one side of the bow and extending outwardly therefrom.

These archery bows may or may not provide a solution to the problem of the bow string striking the archer's forearm. However, these proposed solutions introduce a problem of generating a torque load on the archer's hand, wrist, and forearm as the bow string is drawn back to shoot an arrow, and, therefore, add to the stress on the archer's wrist and forearm in resisting these torque loads.

SUMMARY OF THE INVENTION

The present invention provides a solution to the above-discussed problems.

The present invention provides a hand-grip which is transverse to the longitudinal axes of the bow limbs which eliminates torque loading of the archer's hand and arm when the bow string is drawn back, and also reduces the stress on the archer's back and shoulders.

More particularly, the present invention provides an archery bow comprising a central interconnecting member, or bow riser, having an integral hand-grip means to be gripped by an archer's hand to hold the bow, upper and lower oppositely extending coaxial rigid bow limb attachment arms, an upper resilient bow limb secured at its proximal end to the distal end of the upper bow limb attachment arm of the central interconnecting member, a lower resilient bow limb secured at its proximal end to the distal end of the lower bow limb attachment arm, a bow string interconnecting the distal ends of the resilient upper and lower bow limbs, and the hand-grip means being transversely oriented to the longitudinal axis of the bow limbs and substantially laterally centered on the longitudinal axis of the bow limbs.

BRIEF DESCRIPTION OF THE DRAWINGS

A better understanding of the present invention will be had upon reference to the following description in conjunction with the accompanying drawings, wherein like numerals refer to like parts throughout the several views and in which.

DETAILED DESCRIPTION OF THE PREFERRED EMBODIMENTS

Figure 1:
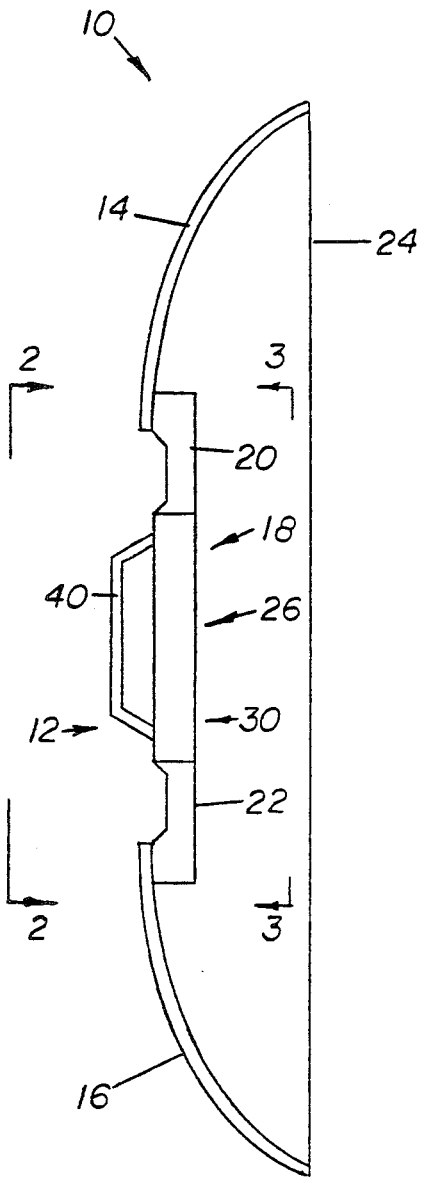
FIG. 1 illustrates a side view of an archer's bow embodying the present invention.
Figure 2:
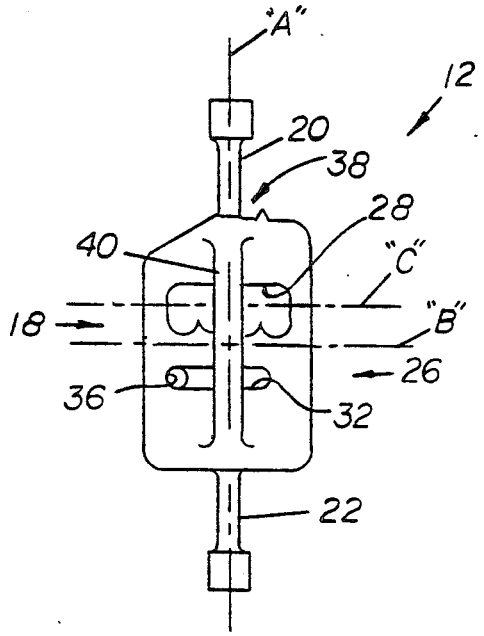
FIG. 2 is a front view of the archer's bow of FIG. 1 as seen in the direction of arrow 2—2 in FIG. 1.
Figure 3:
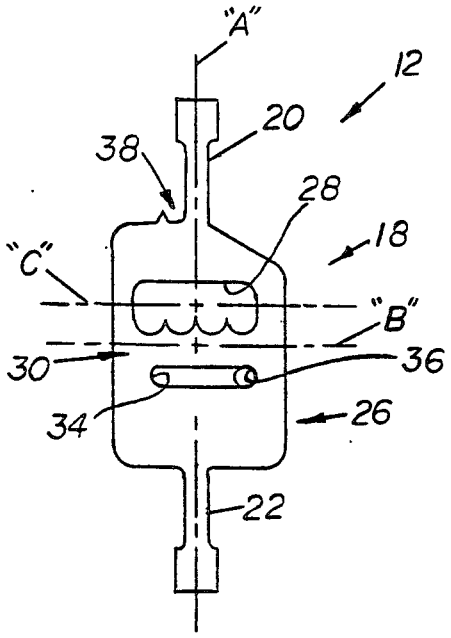
FIG. 3 is a back view of the archer's bow of FIG. 1 as seen in the direction of arrow 3—3 in FIG. 1.

With reference to FIGS. 1-3, there is shown an archery bow, generally denoted as the numeral 10, which includes a central interconnecting member, or bow riser, 12, an upper resilient bow limb 14, and a lower resilient bow limb 16.

The central interconnecting member, or bow riser, 12 is integrally formed with hand-grip means, generally denoted as the numeral 18, and includes an upper extending bow limb attachment arm 20, and a lower oppositely extending bow limb attachment arm 22 longitudinally coaxial with the upper bow limb attachment arm 20. The central interconnecting member 12 is formed of a rigid material such as a plastic, a metal, or a wood. The upper bow limb attachment arm 20 and the lower bow limb attachment arm 20 are shown as also being integrally formed with the hand-grip means 18 so that the central interconnecting member 12 is unitary. However, it is contemplated that the upper and lower bow limb attachment arms can be separate components attached to the hand-grip means 18.

The upper resilient bow limb 14 is secured at its proximal end to the distal end of the upper bow limb attachment arm 20, and the lower resilient bow limb 16 is secured at its proximal end to the distal end of the lower bow limb attachment arm 22. The particular way in the upper bow limb 14 is secured to the upper bow limb attachment arm 20 and the lower bow limb 16 is secured to the lower bow limb attachment arm 22 may be virtually a convenient or otherwise conventional securing means such as, for example, bolts. The particular securing means securing the upper bow limb 14 to the upper bow limb attachment arm 20 and securing the lower bow limb 16 to the low bow limb attachment arm 22 does not comprise a part of the present invention, and, therefore, for the sake of brevity, a particular securing means will not be further described. It is also contemplated that the upper bow limb and upper bow limb attachment arm could be integrally formed, and the lower bow limb and lower bow limb attachment arm could be integrally formed without departing from the scope of the invention.

A bow string 24 interconnects the distal ends of the upper resilient bow limb 14 and the lower resilient bow limb 16 such that the bow string 24 extends parallel to the longitudinal axes of the upper resilient bow limb 14 and the lower resilient bow limb 16.

In FIGS. 2–3, the imaginary line "A" denotes the longitudinal axes of the upper and lower bow limbs 14 and 16, and the imaginary line "B" denotes the transverse centerline of the archery bow 10, and more particularly the transverse centerline of the central interconnecting member 12. As shown, the central interconnecting member 12 includes a mid-section 26 which has a width substantially wider than the width of the upper and lower bow limb attachment arms 20, 22. The hand-grip means 18 is at least as long as the width of an archer's hand and is located in the mid-section 26 of the central interconnecting member 12 with the length transversely oriented to the longitudinal axes of the bow string 24, and, therefore, also transversely to the longitudinal axes "A" of the upper and lower bow limbs 14, 16 and the upper and lower bow limb attachment arms 20, 22. The length dimension of the hand-grip means 18 is also substantially longitudinally centered on the longitudinal axis of the bow string 24.

As can be best seen in FIGS. 2 and 3, the hand-grip means 18 comprises a finger receiving slot, generally denoted as the numeral 28, formed through the mid-section 26 of the central interconnecting member 12. The length of the slot 28 is oriented transversely to the longitudinal axis "A" of the bow limbs 14 and 16 with the length of the slot substantially, longitudinally centered on the longitudinal axis "A" of the bow limbs 14 and 16. The slot 28 receives the fingers of the archer's bow supporting hand therethrough. As shown, the major axis "C" of the slot 28 is spaced above and is substantially parallel to the transverse centerline "B", and the bottom slot defining edge of the slot 28 in the mid-section 26 is also above the transverse centerline "B" of the central interconnecting member 12. The bottom slot defining edge of the slot 28 is formed with contours to receive the fingers of the archer's hand. As shown in FIG. 3, the region, generally denoted as the numeral 30 immediately below the slot 28, that is to the side of the slot 28 closest to the lower bow limb attachment arm 22, defines the portion of the hand-grip means 18 against which the palm of the archer's hand rests. As shown, the palm rest region 30 straddles the transverse centerline "B". In order to make the hand-grip means 18 more comfortable to the archer, a first recess, generally denoted as the numeral 32 is formed in the front side of the central interconnecting member spaced a distance below the finger-receiving slot 28 for receiving the finger tips of the archer's hand, and a second recess, generally denoted as the numeral 34 is formed in the back side of the central interconnecting member below the finger receiving slot 28 for receiving the heel of the palm of the archer's hand. The hand-grip means 18 further includes a thumb hole 36 formed through the mid-section 26 of the central interconnecting member 12 for receiving the thumb of the archer's hand. The thumb receiving hole 36 is located below the finger-receiving slot 28, a preselected distance from the transverse centerline "B", and is offset transversely to one side of the longitudinal axis "A" of the bow limbs 14 and 16. For a right-handed archer, the thumb hole 36 is off-set to the right side of the longitudinal centerline "A", and for a left-handed archer, the thumb hole 36 is off-set to the left side of the longitudinal centerline "A" as viewed from the back side of the archery bow 10. In addition, as can be best seen in FIG. 3, the second recess 34 for the heel of the palm of the archer's hand is open to or extends to the thumb hole 36 to further make the hand-grip means 18 even more comfortable to the archer.

With reference to FIGS. 2 and 3, an arrow rest 38 is positioned on the central interconnecting member 12. More particularly, the arrow rest 38 is located at the juncture of the upper bow limb attachment arm 30 and the top side of the mid-section 26 to one side of the upper bow limb attachment arm 20.

With reference to FIGS. 1 and 2, the archery bow 10 also includes a bow carrying handle 40 for conveniently carrying the bow 10 when not being used. The handle 40 is located over the front side of the central interconnecting member 12, is oriented in alignment with the longitudinal axis "A", and spans the hand-grip means 18. More particularly, the handle 40 is secured at one of its ends to the front side of the central interconnecting member 12 between the first or finger tip receiving recess 32 and the juncture of the lower bow limb attachment arm 22, and is secured at the other of its ends to the front side of the central interconnecting member 12 between the finger receiving slot 28 and the juncture of the upper bow limb attachment arm 20. The portion of the bow carrying handle 40 between its ends is spaced outwardly from the front side of the central interconnecting member 12 by a sufficient distance so as not to interfere with the fingers of the archer's hand extending through the finger-receiving slot 28. The bow carrying handle 40 can be a separate component attached to the central interconnecting member 12, or it can be integral with the central interconnecting member 12.

Figure 4:
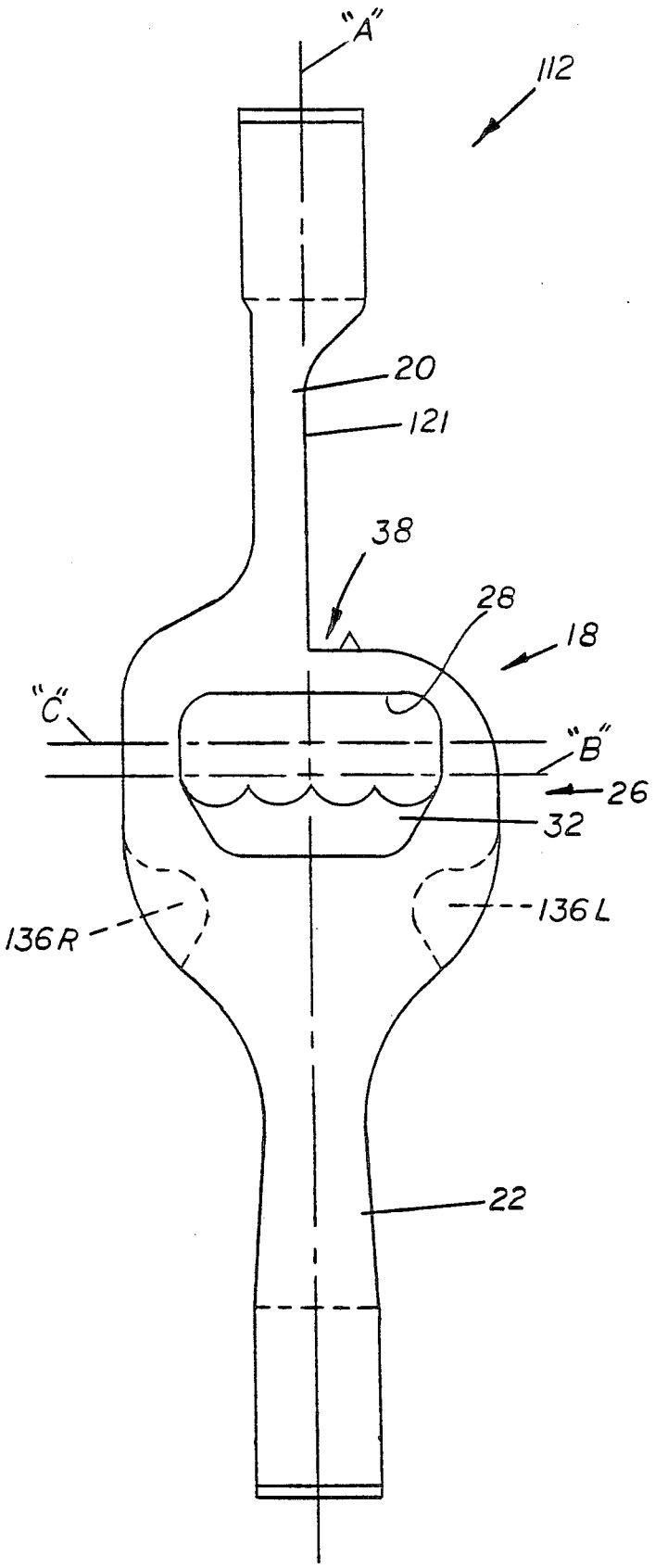
FIG. 4 is a front view of a portion of an archery bow including another embodiment of the present invention.
Figure 5:
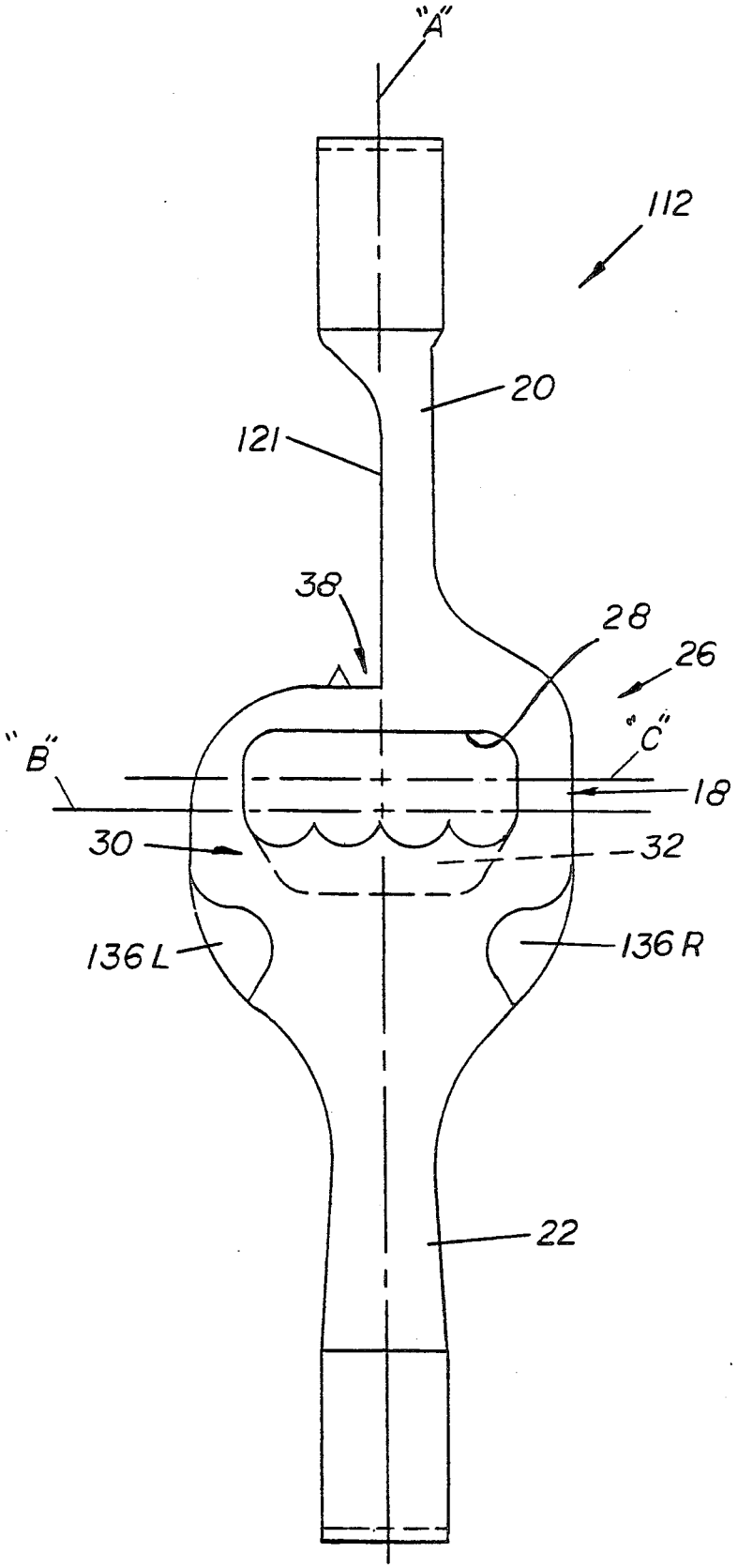
FIG. 5 is a back view of the portion of the archery bow of FIG. 4.

Now with reference to FIGS. 4 and 5, there is shown another embodiment of a central interconnecting member or bow riser, generally denoted as the numeral 112, of the present invention, which is usable by both right-handed and left-handed archers. The central interconnecting member 112 has numerous features in common with the central interconnecting member 12 of FIGS. 1–3 discussed above, and for the sake of brevity, these common features are denoted by identical numbers in FIGS. 4 and 5 and the discussion thereof will not be repeated. As shown in FIG. 5, in the hand-grip means 18 of the central interconnecting member 112, the second recess 34 for the heel of the palm of the archer's hand has been eliminated although it should be understood that the second recess 34 could also be included in this embodiment without departing from the invention. In addition, the thumb hole 36 of the hand-grip means 18 has also been eliminated and replaced by a pair of thumb-receiving recesses 136L and 136R. The recesses 136L and 136R are symmetrical to opposite sides of the longitudinal centerline "A" and are located the same distance spaced below the finger-receiving slot 28. With reference to FIG. 5, the thumb-receiving recess 136L is formed in the back side and is longitudinal centerline "A" as viewed from the back side of the central interconnecting member 112 and the thumb-receiving recess 136R is located to the right side of the longitudinal centerline "A" as viewed from the back side of the central interconnecting member 112. The recess 136L is formed in the back side and is open to the left side surface of the mid-section 26 of the central interconnecting member 112. The recess 136R is formed in the back surface and is open to the right side surface of the mid-section 26 of the central interconnecting member 112. The recess 136L receives the thumb of the right hand of a left-handed archer, and the recess 136R receives the thumb of the left hand of a right-handed archer. In addition, and with continued reference to FIGS. 4 and 5, one side edge 121 of the upper bow limb attachment arm 22 essentially lays on the longitudinal centerline "A" or in alignment with the longitudinal axis of the bow limbs 14 and 16. The arrow rest 38 is located on the top side of the mid-section 26 and immediately adjacent that side edge 121 of the upper bow limb attachment arm 22 further providing ready use of a bow having the central interconnecting member 112 by either left-handed or right-handed archers. As shown in this embodiment, the major axis "C" of the slot 28 is located above and substantially parallel to the transverse axis "B", and the bottom slot defining edge of the slot 28 is located below the transverse centerline "B". Therefore, the palm rest region 30 is below the transverse centerline "B".

Figure 6:
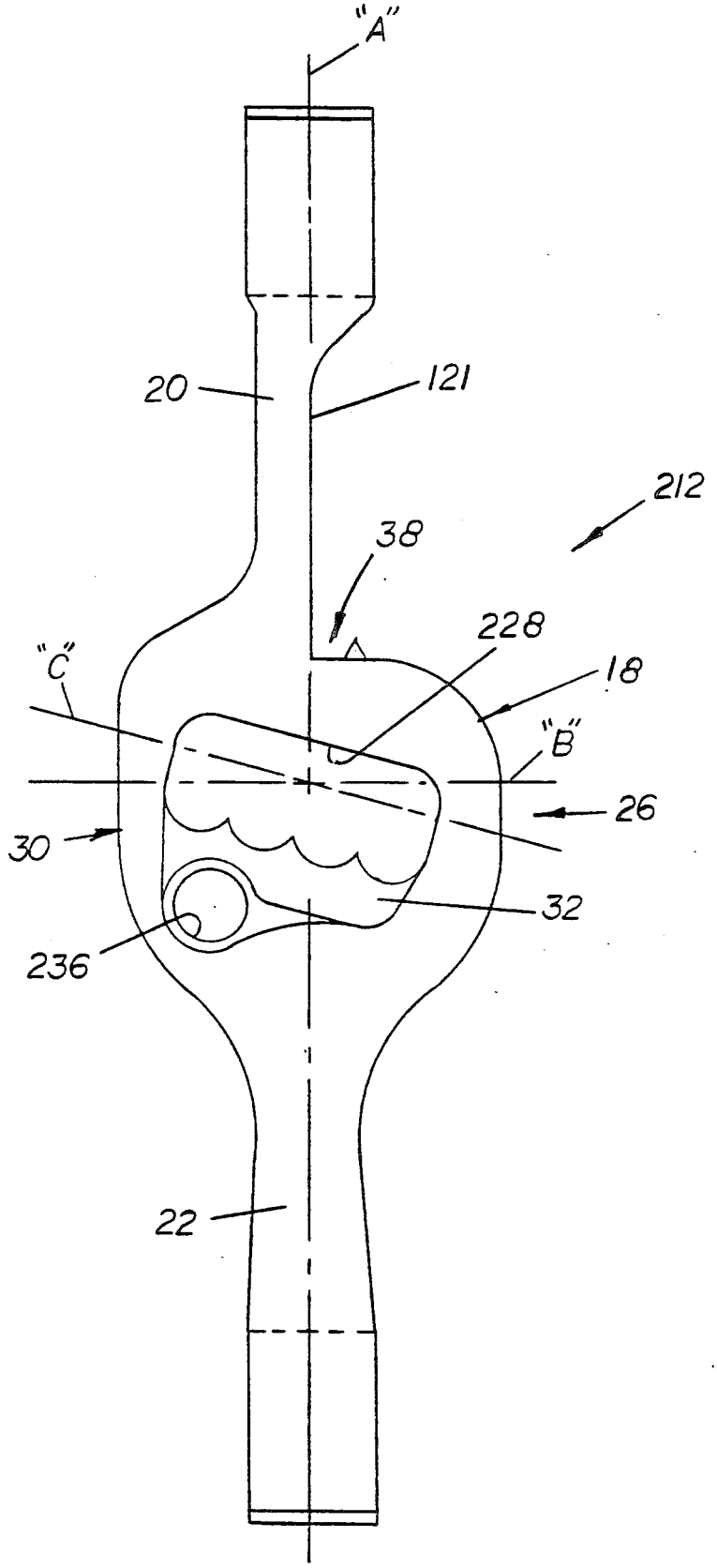
FIG. 6 is a front view of a portion of an archery bow including yet another embodiment of the present invention; and, FIG. 7 is a back view of the portion of the archery bow of FIG. 6.
Figure 7:
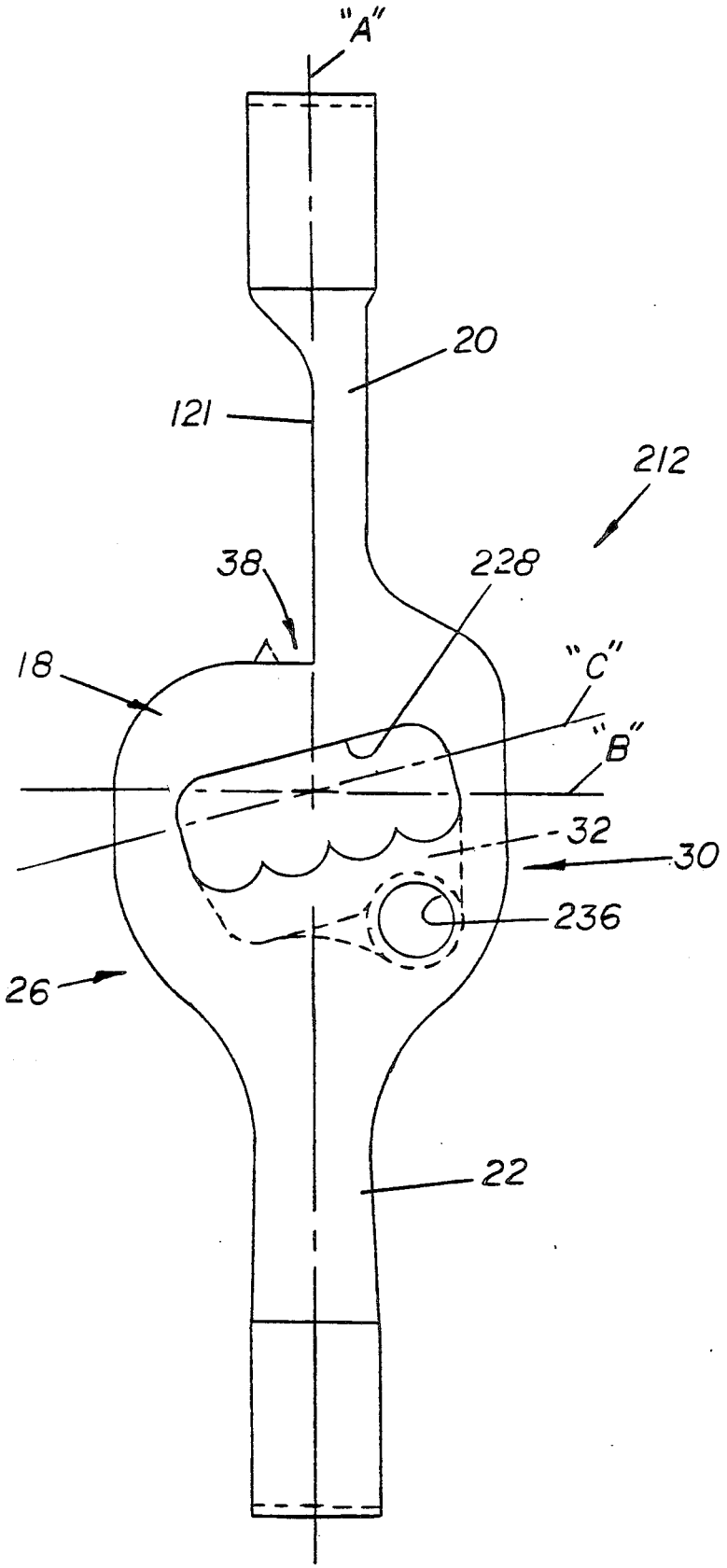

Now with reference to FIGS. 6 and 7, there is shown yet another embodiment of a central interconnecting member, generally denoted as the numeral 212 of the present invention. The central connecting member 212 has numerous features in common with the central connecting member 12 of FIGS. 1–3 and central connecting member 112 of FIGS. 4 and 5 discussed above. Therefore, for the sake of brevity, these common features are denoted by identical numerals in FIGS. 6 and 7 and the discussion thereof will not be repeated. In the central connecting member 212, the transverse finger-receiving slot 228 is positioned at an acute included angle to the transverse centerline "B" such that the major axis "C" is inclinded to the transverse axis "B". In addition, it should be noted that the longitudinal centerline "A" of the central interconnecting member 212, the transverse centerline "B" of the central interconnecting member 212, and the major axis "C" of the finger-receiving slot 228 substantially, mutually intersect. Therefore, as shown, half of the width of the slot 28 is above the transverse centerline "B" and half of the width of the slot 28 is below the transverse centerline "B". The bottom slot defining edge of the slot 28 is located below the transverse centerline "B" and the palm rest region 30 is below the transverse centerline "B". As shown, the central interconnecting member 212 is for a right-handed archer. The central interconnecting member 212 can be made suitable for use by a left-handed archer by forming the finger-receiving slot 228, and any associated thumb-receiving hole 236 as a mirror image to that shown in FIGS. 6 and 7.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

I claim:

1. An archery bow comprising:

a central interconnecting member having an integral hand-grip means to be gripped by an archer's hand to hold the bow, and integral upper and lower oppositely extending coaxial rigid bow limb attachment arms;

an upper resilient bow limb secured at its proximal end to the distal end of the upper bow limb attachment arm of the central interconnecting member;

a lower resilient bow limb secured at its proximal end to the distal end of the lower bow limb attachment arm;

a bowstring interconnecting the distal ends of the resilient upper and lower bow limbs; and, the hand-grip means comprising an elongated finger receiving slot for receiving the fingers of the hand of the archer, the elongated slot being formed through the central interconnecting member with the length of the elongated slot being transversely oriented to the longitudinal axis of the bow, and the length of the elongated slot being longitudinally centered on the longitudinal axis of the bow and thereby the elongated slot being transversely oriented to the longitudinal axis of the bowstring and longitudinally centered on the longitudinal axis of the bowstring.

2. The archery bow of claim 1, wherein the slot is formed with contours to receive the individual fingers of the archer.

3. The archery bow of claim 1, wherein the hand-grip means further comprises a first recess formed in the front side of the central interconnecting member below the finger-receiving slot for receiving the finger tips of the archer's hand extending through the finger-receiving slot.

4. The archery bow of claim 1, wherein the hand-grip means further comprises a second recess formed in the back side of the central interconnecting member below the finger-receiving slot for receiving the heel of the palm of the archer's hand.

5. The archery bow of claim 1, wherein the hand-grip means further comprises a hole formed through the central interconnecting member below the finger-receiving slot and offset transversely to one side of the longitudinal axis of bow string for receiving the thumb of the archer's hand.

6. The archery bow of claim 1, wherein the hand-grip means further comprises a recess formed in one side surface of the central interconnecting member below the finger-receiving slot for receiving the thumb of the archer's hand.

7. The archery bow of claim 1, wherein the hand-grip means further comprises a pair of recesses, one formed in each of the two side surfaces of the central interconnecting member below the finger-receiving slot, one of the recesses for receiving the thumb of the left hand of the right-handed archer, and the other one of the recesses for receiving the thumb of the right hand of a left-handed archer.

8. The archery bow of claim 1, wherein the longitudinal axis of the elongated slot is substantially perpendicular to the longitudinal axis of the bowstring.

9. The archery bow of claim 1, wherein the longitudinal axis of the elongated slot is at an acute included angle to the longitudinal axis of the bowstring.

* * * * *